United States Patent [19]

Bongard et al.

[11] Patent Number: 4,678,867

[45] Date of Patent: Jul. 7, 1987

[54] ELECTRICAL DEVICE WITH PROTECTIVE SHROUD FOR FLEXIBLE ELECTRICAL CABLE EXTENDING THEREFROM

[75] Inventors: James A. Bongard; Michael J. Delaney, both of Milwaukee; Eugene F. Duncan, Wauwatosa; Cheryl A. Fredricks, Milwaukee; John P. Groves, Milwaukee; Daniel J. Kalista, Milwaukee; Paul Klingseisen, Milwaukee; Joseph Lazzaro, Milwaukee; Gregory L. Nadolski, Brookfield, all of Wis.

[73] Assignee: Eaton Corporation, Cleveland, Ohio

[21] Appl. No.: 892,007

[22] Filed: Aug. 1, 1986

[51] Int. Cl.[4] ..... H01R 13/56

[52] U.S. Cl. ..... 174/135; 33/172 E; 250/239; 439/445

[58] Field of Search ..... 174/5 R, 81, 82, 135, 174/138 F; 339/101, 103 R, 103 M, 116 R, 116 C; 33/172 E; 250/239

[56] References Cited

U.S. PATENT DOCUMENTS 2,875,266 2/1959 Fredericks ..... 174/138 F
4,573,272 3/1986 Golinelli et al. ..... 339/101 X

FOREIGN PATENT DOCUMENTS 2824463 1/1979 Fed. Rep. of Germany ... 339/116 R
WO82/03296 9/1982 PCT Int'l Appl. ..... 339/103 M
2134722 8/1984 United Kingdom ..... 339/101

*Primary Examiner*—Laramie E. Askin
*Attorney, Agent, or Firm*—D. A. Rowe; L. G. Vande Zande

[57] ABSTRACT

A protective shroud (22) for a flexible electrical cable (20) at the location where it emerges coaxially from the rear end (14) of an electrical device, such as an inductive proximity or photoelectric sensor (2), serving as a strain relief and protection from being bumped as well as retaining such electrical cable (20) at a gradual right-angle bend from a horizontally-mounted sensor (2) to keep it out of the way, such as from the aisle adjacent a conveyer on which the sensor is mounted. Snap-in means including an annular groove (18) on the rear end of the sensor (2) and a constricted-opening (**22*f*) slot (22*e*) in the inner side wall (22*d*) of the shroud (22) afford snap-in mounting of the latter onto the rear end (14) of the sensor (2) with the shroud (22) being rotatable thereon to allow the electrical cable (20) to be oriented in any desired direction. Another version of protective shroud (24) adapted for a vertically-mounted sensor (2) in FIG. 3 has its snap-in slot (24*f*) in its upper end wall (24*e*) so as to surround and protect the downwardly hanging cable (20) at the location where it emerges from the rear end (14) of the vertically-mounted sensor (2). The shroud (22,24**) is mounted of plastic material of a selected color to identify the product of a particular manufacturer.

5 Claims, 5 Drawing Figures

ELECTRICAL DEVICE WITH PROTECTIVE SHROUD FOR FLEXIBLE ELECTRICAL CABLE EXTENDING THEREFROM

BACKGROUND OF THE INVENTION

A protective insulating cap assembly for the threaded electrical terminal stud and the ends of the conductors attached thereto of an electrical sensing unit such as a thermocouple element has been known heretofore. For example, W. Fredericks U.S. Pat. No. 2,875,266, dated Feb. 24, 1959, shows a protective electrically insulating cap assembly for the threaded terminal stud of a sensing unit to protect it against accidental contact with grounded objects and consequent short-circuiting and also against mechanical damage due to maintenance crews bumping their tools thereagainst. While such protective insulating caps have been useful for protecting threaded terminals and also the conductors attached to such threaded terminals at a sharp 90° angle by means of O-ring connectors and nuts, they have nevertheless been unsuitable for protecting electrical cables that emerge axially (rather than being connected perpendicularly) from electrical devices, such as tubular sensors of the photoelectric or magnetic type or the like. Also, such prior protective insulating caps have not been suitable for retaining such electrical cables that emerge from horizontally mounted sensors from extending into the aisle adjacent the conveyor or the like on which the sensor is mounted. This invention relates to improvements thereover.

SUMMARY OF THE INVENTION

An object of the invention is to provide an electrical device with an improved protective device for a flexible electrical cable extending therefrom.

A more specific object of the invention is to provide a simple and economical protective shroud at the point where an electrical cable emerges from an electrical device.

Another specific object of the invention is to provide an electrical device with a snap-on protective shroud for a flexible electrical cable that projects coaxially from the electrical device.

Another specific object of the invention is to provide an electrical device with snap-on protective shroud for a flexible electrical cable projecting from the electrical device so as to retain the flexible cable bent at a gradual angle substantially perpendicular to the axis of such electrical device to keep the remainder of such cable away from the aisle adjacent a conveyor or the like on which the electrical device is mounted.

Another specific object of the invention is to provide a tubular sensor or the like with an improved strain relief protective shroud along with snap-on means for mounting the same at the rear end of a tubular sensor or the like at the point where the flexible cable emerges from the sensor or the like.

Another specific object of the invention is to provide an electrical device with an improved protective shroud of the aforementioned type which can be readily and economically molded of plastic material of one or more colors for identification purposes.

Other objects and advantages of the invention will hereinafter appear.

DESCRIPTION OF THE PREFERRED EMBODIMENTS

Figure 1:
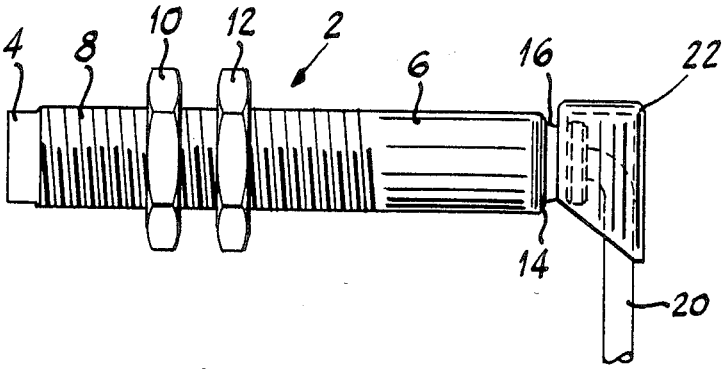
FIG. 1 is an elevational view of a photoelectric or inductive sensor of the tubular type shown in horizontally mounted orientation with a first form of protective shroud mounted at its right-hand or rear end where the flexible electrical cable emerges from the sensor.

Referring to FIG. 1, there is shown an electrical device 2 such as a photoelectric sensor of the tubular type. While a photoelectric sensor is referred to for exemplary purposes, it will be apparent that the invention may be applied to any other type of electrical device, such as, for example, an inductive proximity sensor or a capacitive sensor. This photoelectric sensor 2 has light emitting and receiving elements such as a light emitting diode (LED) and a phototransistor mounted at its forward or left-hand end 4 within housing 6 for emitting a light and receiving a reflected light from an object or reflector to detect the presence thereof.

As shown in FIG. 1, sensor 2 is adapted to be mounted horizontally on a support such as a conveyor or the like to sense the presence of articles being conveyed therealong. For this purpose, tubular housing 6 is provided with an external thread 8 along a substantial portion thereof onto which are threaded a pair of nuts 10 and 12 between which a supporting member can be clamped thereby to support the sensor rigidly on the conveyor.

Figure 5:
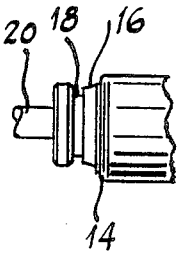
FIG. 5 is a fragmentary view of the rear end portion of the sensor of FIG. 1 or FIG. 3 showing the annular groove onto which the protective shroud is snap-in mounted.

At its right-hand or rear end 14, sensor 2 is provided with a reduced portion in the form of a cylindrical projection 16 having an annular groove 18 therein, as more clearly shown in the fragmentary illustration in FIG. 5. An electrical cable 20 extends out coaxially from the rear end of this reduced portion of the sensor, this electrical cable 20 preferably having a plurality of electrical conductors, such as three for example, whereby electrical energy is conducted to the light emitting element at the forward end of the sensor and an electrical signal is transmitted back out to an electrical circuit or system to which cable 20 is connected. As shown in FIG. 1, sensor 2 is adapted to be mounted horizontally on the support on which it is to be used. When it is used on a conveyor or the like, it will be apparent that forward or sensing end 4 of this sensor 2 is directed toward the center of the conveyor and that rear end 14 extends toward the aisle that is located along and adjacent to the conveyor.

Since cable 20 extends out coaxially from the rear end of sensor 2, which facilitates sealing it in the sensor, it will be apparent that this cable has a tendency, unless controlled, to project out into the aisle to get in the way and also a tendency to be bumped and damaged so that it would be desirable to provide protecting and guiding means therefor. A cable of this type is flexible because it contains a number of electrical wires and if it is bumped or flexed repeatedly it will have a tendency to break at its point of emergence from the rear end of sensor 2. To protect the cable 20 at this point, there is provided a protective device 22 in the form of a plastic molded shroud that is snap-in mounted onto annular groove 18 at the rear end of sensor 2. As shown in FIG. 1, this shroud 22 not only protects cable 20 at the point where it emerges from the rear end of sensor 2 to prevent flexing and breakage thereof but also is constructed so that it places a gradual right angle bend in this flexible cable 20, this bend being a downward bend as shown in FIG. 1, to retain and confine the remainder of this cable in close proximity to the conveyor and out of the aisle. In this way, shroud 22 provides strain relief at the point where it is most needed, that is, at the point where the cable emerges from the rear end of sensor 2.

Figure 2:
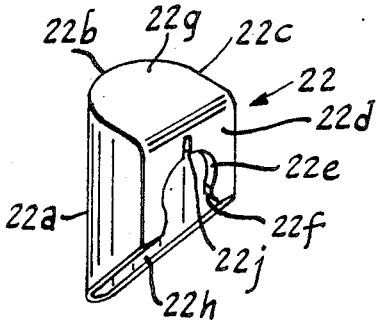
FIG. 2 is an isometric view of the protective shroud of FIG. 1 showing its snap-in slot.

As shown in FIG. 2, shroud 22 is provided with a first wall having three contiguous sides 22*a*, 22*b* and 22*c* which act as barriers to protect cable 20 on all sides except the conveyor side. In the version shown in FIG. 2, at the conveyor side there is a second wall 22*d* of the shroud 22 which extends between sides 22*a* and 22*c* and which is partially closed except that it is provided with a snap-in slot 22*e* molded so that it is complementary to the bottom of annular groove 18 over more than 180° thereof, a constricted opening 22*f* through which the rear end portion of sensor 2 will pass with a snap-in action when the shroud is mounted on the sensor with a downward thrust and a narrow slit 22*j* extending upwardly from slot 22*e* to enhance flexibility of the shroud for snap-in mounting. For this purpose, it will be apparent that shroud 22 is molded of plastic molding material that has the desired stiffness but yet has sufficient resiliency so that it can be snap-in mounted onto the sensor. Upper end 22*g* of the shroud 22 is preferably molded so that it is closed and continuous with the four sides. Lower end 22*h* of the shroud is completely open so that cable 20 can project freely therefrom. While shroud 22 in FIG. 1 is shown directed so that cable 20 extends downwardly, it will be apparent that due to the nature of the snap-in structure, that is, an annular groove 18 on the rear end of the sensor and a snap-in slot 22*e* on the shroud complementary thereto, this shroud can be rotated on the sensor and directed so that cable 20 extends to either side horizontally or even upwardly if desired. Also, this construction of protective shroud can be manufactured very economically because it is molded in a single piece and without additional cost can be given a desired color to identify a particular manufacturer's product.

It will be apparent that if the rear end of the sensor is accidentally bumped, all of the force thereof will be taken up by the shroud so that it will not be imparted to cable 20 at the point where it emerges from the rear end of the sensor. If the shroud is bumped hard enough, the most that can happen is that it will be snapped off the end of the sensor whereafter it can be reinstalled.

In the prior art such as the terminal protective device shown in the aforementioned Fredericks patent, it will be apparent that it has been the practice to construct the terminal so that the wire or cable will extend perpendicularly from the electrical device; but such a construction is handicapped by the fact that it then requires a connector to connect the cable to the electrical device, as distinguished from the invention wherein the cable 20 comes straight out of the rear end of the sensor 2. Therefore, the sealing on prior art connectors is not as good as it is in the invention since it is easier to seal the cable as it emerges from the rear end of the tubular sensor. This sealing is important in order to prevent contaminants and water from entering the sensor.

Figure 3:
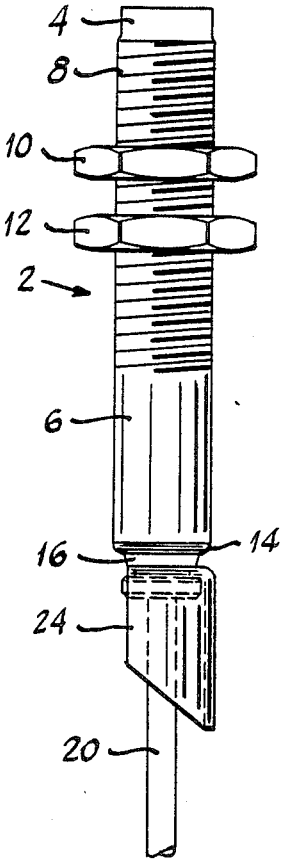
FIG. 3 is an elevational view of a vertically mounted photoelectric or inductive sensor of the tubular type or the like showing a second form of protective shroud mounted at the lower or rear end thereof where the flexible electrical cable emerges from the sensor.
Figure 4:
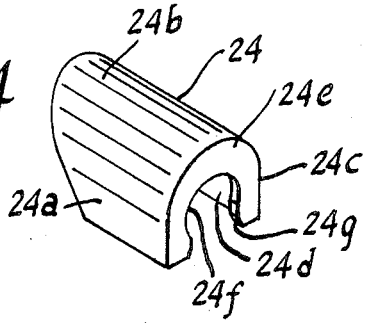
FIG. 4 is an isometric view of the protective shroud of FIG. 3 showing the snap-in slot.

FIG. 4 shows a modified version of a protective device 24 adapted for use with a vertically mounted sensor 2 shown in FIG. 3. The sensor 2 shown in FIG. 3 is similar to that in FIG. 1 and reference characters like those in FIG. 1 have been used for the parts thereof in FIG. 3. As shown in FIG. 4, shroud 24 is molded of plastic material so that it has a first wall with three contiguous sides 24*a*, 24*b* and 24*c* and is open at 24*d* opposite side 24*b*. The side 24*b* preferably is rounded similar to side 22*b* in FIG. 2 to present a smooth, rounded external configuration without corners. Since this shroud 24 is adapted for mounting onto a vertically mounted sensor as shown in FIG. 3, its upper end has a second wall 24*e* extending between sides 24*a* and 24*c* which is closed except that it is provided with a snap-in slot 24*f* having a constricted opening 24*g* thereinto from the open side of the shroud 24. This snap-in slot 24*f* is similar to slot 22*e* in FIG. 2 in that it is complementary to the bottom of annular groove 18 throughout more than 180° for secure retention on the end of the sensor. As shown in FIG. 3, cable 20 extends straight downwardly from the lower end of sensor 2. Shroud 24 is snap-on mounted onto the lower end of sensor 2 so as to surround cable 20 on three sides including the aisle side and the adjacent left and right sides to protect and provide strain relief to cable 20 at the point where it emerges from the lower end of sensor 2.

While the apparatus hereinbefore described is effectively adapted to fulfill the objects stated, it is to be understood that the invention is not intended to be confined to the particular preferred embodiments disclosed, inasmuch as it is susceptible of various modifications without departing from the scope of the appended claims.

We claim:

1. An electrical device with protective shroud for flexible electrical cables comprising, in combination:

an electrical device mounted on a support structure, said electrical device having a cylindrical projection extending therefrom and a flexible electrical cable extending axially from said cylindrical projection;

an annular groove in said cylindrical projection;

a shroud comprising a first wall having first, second and third contiguous sides and a second wall extending between said first and third sides;

a snap-in slot complementary to said annular groove and having a constricted opening formed in said second wall;

said shroud being attached to said cylindrical projection by pressing said constricted slot into said groove, said first wall enveloping said cable adjacent said projection on at least three sides which are directed away from said support structure.

2. The combination as claimed in claim 1, wherein:

said shroud is a single molded piece of plastic material.

3. The combination as claimed in claim 1, wherein:

said annular groove and said snap-in slot provide bearing means for rotation of said shroud axially of said projection.

4. The combination as claimed in claim 1, wherein:

said second wall is disposed across edges of said first and third sides of said first wall opposite said second side, said second side blocking said cable in the direction said cable extends from said projection and redirecting said cable at substantially a right angle.

5. The combination as claimed in claim 1, wherein:

said second wall is disposed across edges of said first and third sides and contiguous with an edge of said second side of said first wall, said second side being parallel to the direction said cable extends from said projection.

* * * * *